United States Patent [19]

Root et al.

[11] Patent Number: 4,764,293

[45] Date of Patent: Aug. 16, 1988

[54] LUBRICANT COMPOSITIONS

[75] Inventors: Jon C. Root, Leawood; John F. Barnes, Olathe; Ray D. Lawson, Shawnee, all of Kans.

[73] Assignee: Witco Corporation, New York, N.Y.

[21] Appl. No.: 90,599

[22] Filed: Aug. 28, 1987

[51] Int. Cl.[4] ..... C10M 133/56

[52] U.S. Cl. ..... 252/12.4; 252/12.6; 252/13; 252/14

[58] Field of Search ..... 252/12.4, 12.6, 13, 252/14

[56] References Cited

U.S. PATENT DOCUMENTS 3,520,807 7/1970 Cross et al. ..... 252/13

4,575,430 3/1986 Periard et al. ..... 252/12.4

*Primary Examiner*—Jacqueline V. Howard

*Attorney, Agent, or Firm*—Wallenstein, Wagner, Hattis & Strampel, Ltd.

[57] ABSTRACT

Lubricant compositions adapted for use under extreme conditions comprising a major proportion of an oil or grease base material, and a minor proportion of an aromatic polyamide fibrous substance in an amount sufficient to impart a fibrous texture to the base material.

7 Claims, No Drawings

LUBRICANT COMPOSITIONS

FIELD OF THE INVENTION

The present invention relates to lubricant compositions, and, in particular, to fibrous lubricant compositions adapted for use under heavy duty or high stress conditions.

BACKGROUND OF THE PRIOR ART

Fibrous lubricant compositions, especially fibrous greases have been developed to meet the demand for greases having high dropping points with good shear stability. Such greases are used where shock loading is prevalent, a condition which occurs, for example, in the ball joints of automotive vehicles, and the pivot points on end loaders. Fibrous greases are preferred over smooth textured greases for such uses because of the loose tolerances in the lubricated contacts. Loose fitting parts, upon impact, will tend to squirt a smooth textured grease out of the contacts, whereas a fibrous grease will be drawn back into the lubricated contacts when the loose fitting parts are separated, due to the fibrous texture of the grease. The two most widely used fibrous greases are barium base greases and sodium base greases. Barium base greases are somewhat toxic and can lose their fibrous texture after prolonged use at high temperature due, in the main, to the loss of the overall amount of water which is added to such greases to impart a fibrous texture to them. Sodium base greases, like barium base greases, also tend to lose their fibrous texture under prolonged high temperature use conditions for the same reason, and have the added disadvantage of being water sensitive, that is, the sodium fibers comprising the grease are soluble in water, resulting in grease failure upon exposure of the grease to excessive amounts of water, or moisture.

BRIEF SUMMARY OF THE INVENTION

In accordance with the present invention, improved fibrous greases have been evolved which are uniquely adapted for use in environments where shock loading is prevalent. The greases of this invention are characterized in that they are non-toxic, are water insensitive, and do not lose their fibrous texture after prolonged use at high temperatures. In brief, the fibrous lubricant compositions of this invention comprise a major proportion of a lubricating grease base, and a minor proportion of an organic fibrous substance or material. The organic fibrous materials useful for the purposes of this invention are characterized in that they are non-abrasive, and water and oil insoluble. They also are characterized in that they are essentially non-melting at the high temperatures encountered in heavy duty or high stress lubricant applications and, therefore, retain their integrity for prolonged periods. They are further characterized in that they are inert both with respect to the grease components and any metal surface with which they come into contact. The organic fibrous materials also have the added unique advantage of requiring only low concentrations to impart a fibrous texture to the compositions. The organic fibrous materials are readily commercially available, and their ability to impart a fibrous texture to the base grease at low concentrations makes the compositions of invention competitive with conventional fibrous greases. A further unexpected and surprising property of the fibrous materials used in formulating the greases of this invention is their ability to raise the dropping point of certain grease bases into which they are incorporated.

DETAILED DESCRIPTION OF THE INVENTION

The organic fibrous materials useful in the practice of the present invention advantageously are fiber-forming wholly aromatic polyamides formed by the reaction of an aromatic diamine with an aromatic diacid halide. A specific example of such a polyamide is poly(p-phenyleneterephthalamide). Methods of preparing such polyamides are the subject matter of U.S. Pat. Nos. 3,063,966 and 4,511,623. An especially preferred aromatic polyamide is the product sold under the designation KEVLAR (E. I. DuPont de Nemours & Co.).

The fibers formed from the wholly aromatic polyamides may be used in pulp form or as chopped fibers. In pulp form, the fibers are short, and highly fibrillated, having average lengths of the order of about 0.08 to about 0.16 inch. The chopped fibers may vary in length from about ¼ inch to about ½ inch, more or less. Fiber diameters range from about 0.2 mils to about 0.5 mils. The fibers are characterized by their high strength, toughness, and wear resistance, as well as their non-abrasive properties. They have excellent stability at high temperatures, manifesting no tendency to melt or soften at temperatures in excess of 600° F.

The lubricant base materials useful in the preparation of the lubricant compositions of this invention desirably have dropping points above about 300° F. The generally optimum objectives of the invention are attained with lubricant base materials having dropping points of about 300° F. to about 650° F., especially lubricant base materials having dropping points of about 450° F. to about 550° F. Illustrative examples of such lubricant base materials are the metal soap-thickened mineral oil base greases such as lithium stearate and lithium hydroxy stearate greases, calcium stearate greases, aluminum hydroxy-benzoate-stearate greases, and the like. Also useful are metal soap-thickened synthetic hydrocarbon oils, synthetic ester oils, alkyl benzenes, and silicone oils. In addition, clay based greases such as bentonite and attapulgite grease can be used, as can silica gel greases, and polyurea greases.

The proportion or concentration of the organic fibrous material used in formulating the lubricant compositions is low, ranging from about 0.1% to about 2 or 3%, preferably about 0.2% to about 0.5%, by weight of the composition. Conventional equipment and techniques can be utilized to attain uniform distribution or dispersion of the organic fibers in the lubricant base material.

The fibrous character of the lubricant compositions can be enhanced by adding various polymers and tackifiers to enhance the viscosity, the viscosity index and tackiness of the compositions. Exemplary of polymers and tackifiers which can be used are polybutene, polyisobutylene, styrene-isoprene, polymethacrylate, ethylene-propylene copolymers, and natural and synthetic rubbers. The concentration of polymer used can range from about 0.1% to about 30%, preferably about 5% to about 10%, by weight of the composition. The concentration of tackifers such as natural rubber or synthetic rubber can be of the order of 0.1% to abot 2 or 3%. Mixtures of polymers and tackifiers can, of course, be used.

In order to impart coloring characteristics to the lubricant compositions of this invention which are comparable to those of conventional fibrous greases, a pigment, dyes, or a mixture of pigments, and/or dyes advantageously is added to the compositions. Exemplary of such pigments are titanium dioxide, and carbon black, and mixtures therof. The concentration of the pigment used can range from about 0.2% to about 1 or 2%, usually about 0.5% to about 0.8%, by weight, of the total weight of the composition. Various known oil soluble dyes can be added in concentrations of 0.01%, by weight, or less.

The following examples are illustrative of the preparation of fibrous grease compositions in accordance with the present invention. It will be understood that said examples are not to be construed as limitative of the invention since various changes can be made in the formulations in the light of the guiding principles and teachings provided herein:

EXAMPLE I

| Ingredient | Percent (By weight) |
|---|---|
| Polyurea Thickened Grease Base having a viscosity of 600 SUS at 100° F. | 98 |
| Polyamide fibers (Kevlar 29) | 2 |

EXAMPLE II

| Ingredient | Percent (By weight) |
|---|---|
| Polyurea Thickened Grease Base having a viscosity of 450° SUS at 100° F. | 92.5 |
| Polyamide fibers (Kevlar 29) | 0.5 |
| Polymer tackifier (polyisobutylene) | 7 |

We claim:

1. A fibrous lubricant composition for use in heay duty or high stress environments, consisting essentially of: a major proportion of a lubricating grease, and a minor proportion of an organic fibrous substance formed of a wholly aromatic polyamide, said organic fibrous substance being characterized in that it has a melting point in excess of 600° F., and being present in an amount sufficient to impart a fibrous texture to the lubricant composition.

2. A lubricant composition according to claim 1 wherein the organic fibrous substance is water and oil insoluble.

3. A lubricant composition according to claim 1 wherein the concentration of organic fibrous substance is about 0.1% to about 3%, by weight, of the lubricant composition.

4. A lubricant composition according to claim 1 wherein a minor proportion of a polymer is added to the lubricating grease as a tackifying agent to increase the viscosity, viscosity index and a tackiness of the composition.

5. A lubricant composition according to claim 1 wherein the fibers of the organic fibrous material are non-abrasive and have a length of about 0.08 to about 0.16 inch, and a diameter of about 0.2 to about 0.5 mils.

6. A lubricant composition according to claim 1 wherein the organic fibrous material comprises fibers formed of poly(p-phenylenetetraphthalamide).

7. A lubricant composition according to claim 4 wherein the tackifying agent is selected from the group consisting of polybutene, polyisobutylene, styrene-isoprene, polymethacrylate, ethylene-propylene copolymers, and natural and synthetic rubbers.

* * * * *